US007076817B1

(12) United States Patent
Garver

(10) Patent No.: US 7,076,817 B1
(45) Date of Patent: Jul. 18, 2006

(54) CONVALESCENT BED

(76) Inventor: Dolores Garver, 5101 Carriage Way Ct., Apt. 204B, Rolling Meadows, IL (US) 60008

( * ) Notice: Subject to any disclaimer, the term of this patent is extended or adjusted under 35 U.S.C. 154(b) by 0 days.

(21) Appl. No.: 10/887,044

(22) Filed: Jul. 7, 2004

Related U.S. Application Data

(60) Provisional application No. 60/485,650, filed on Jul. 9, 2003.

(51) Int. Cl.
*A47C 21/08* (2006.01)
*A61G 7/053* (2006.01)

(52) U.S. Cl. ..... 5/424; 425/430

(58) Field of Classification Search ..... 5/424, 5/425, 428, 430, 185, 611
See application file for complete search history.

(56) References Cited

U.S. PATENT DOCUMENTS

| | | | | |
|---|---|---|---|---|
| 5,052,065 | A * | 10/1991 | West | 5/424 |
| 5,592,705 | A * | 1/1997 | West | 5/424 |
| 5,745,936 | A * | 5/1998 | Van McCutchen et al. | 5/600 |
| 5,894,616 | A * | 4/1999 | Graham et al. | 5/424 |
| 6,594,835 | B1 * | 7/2003 | West | 5/424 |
| 6,601,251 | B1 * | 8/2003 | Paul | 5/611 |

* cited by examiner

*Primary Examiner*—Michael Trettel
(74) *Attorney, Agent, or Firm*—Kenneth L Tolar

(57) ABSTRACT

A convalescent bed for safely restraining a bedridden patient includes a bed frame with a mattress that is raised and lowered by a hydraulic or electric lifting arm. The bed frame includes a pair of opposing guard rails one of which includes pivotally connected panels that may be deployed when the mattress is in the lowered position thereby providing a ramp on which a patient safely lands in the event he or she rolls off the mattress while receiving treatment.

4 Claims, 2 Drawing Sheets

CONVALESCENT BED

CROSS REFERENCE TO RELATED APPLICATIONS

This application is entitled to and hereby claims the benefit of provisional application No. 60/485,650 filed on Jul. 9, 2003.

BACKGROUND OF THE INVENTION

1. Technical Field of the Invention

The present invention relates to a convalescent bed designed primarily to protect alzheimer patients from falling out of bed.

2. Description of the Prior Art

Many nursing home and hospital patients, or others such as those inflicted with Alzeimer's disease are prone to falling from their beds. Because a conventional mattress is positioned well above the floor, a fall can result in serious injury or death. Restraint of these patients is not lawful in most states because it may result in the patient choking or becoming dangerously entangled. Additionally, the discomfort associated with conventional restraint can be unbearable. As such, patients who are prone to falling out of bed are often transferred to a mattress or other sleeping surface positioned on the floor. To transfer a patient from the bed to the sleeping surface, however, health care workers must manually lift the patient which is dangerous, strenuous and may result in the patient being inadvertently dropped causing severe if not fatal injuries. Accordingly, there is currently a need for a device that safely positions and protects a patient while lying in bed. The present invention satisfies such need by providing a uniquely designed bed having a mattress that can be lowered to a height proximal ground level. Furthermore, the bed includes at least one guard rail that can be unfolded to provide a deployment ramp from the mattress to the floor providing a safe surface on which the patient lands in the event he or she rolls out of bed when the rails are lowered. Furthermore, the deployed ramp provides a work surface for a nurse or caregiver when tending to the patient.

SUMMARY OF THE INVENTION

The present invention relates to a convalescent bed. The device comprises a substantially rectangular bed frame including a pair of opposing end boards with a mattress support structure extending therebetween. A mattress rests on the support structure. Each end board includes an inwardly facing side each having a pair of vertically disposed guide tracks positioned thereon. Each guide track receives a protrusion extending from an end of the support structure for guiding it upwardly or downwardly. An electrical or hydraulic lifting means automatically raises and lowers the mattress support structure. Positioned adjacent each of two sides of the mattress and extending between the spaced end boards is a guard rail. A first guard rail includes an elongated panel having a padded inner surface. The panel includes two opposing ends each of which are slidably received within a track positioned on a respective end board allowing the panel to be easily removed. The opposing guard rail includes a pair of hingedly joined panels each having a padded inwardly facing surface. The guard rail is secured in a collapsed, vertical position with a spring-biased pin. The guard rail may be deployed such that a first inner panel folds downwardly and a second panel is folded underneath thereby forming a padded ramp on which a patient lands in the event he or she inadvertently rolls out of bed.

It is therefore an object of the present invention to provide a convalescent bed that safely restrains a bedridden patient.

It is another object of the present invention to provide a convalescent bed that eliminates the problems associated with restraining a bedridden patient.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
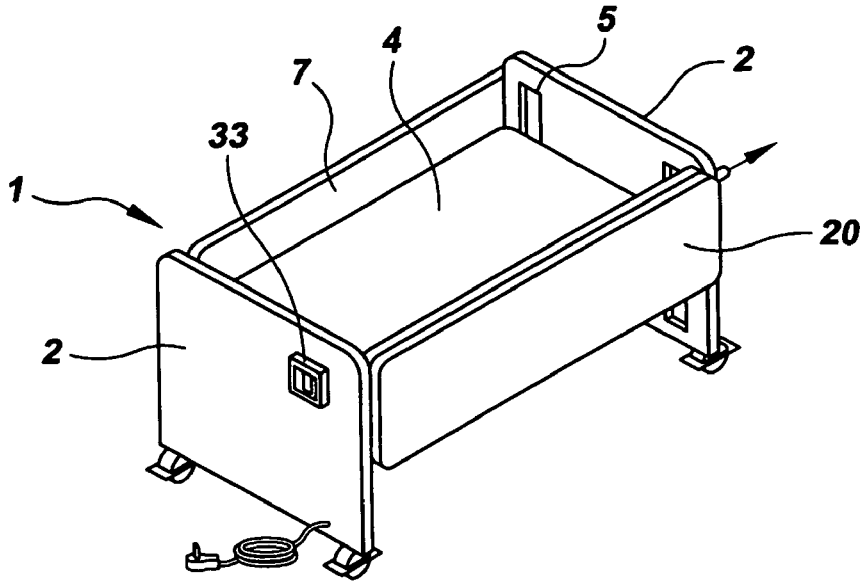
FIG. 1 is a perspective view of the bed according to the present invention with the mattress and guard rails in a normal, operable position.
Figure 2:
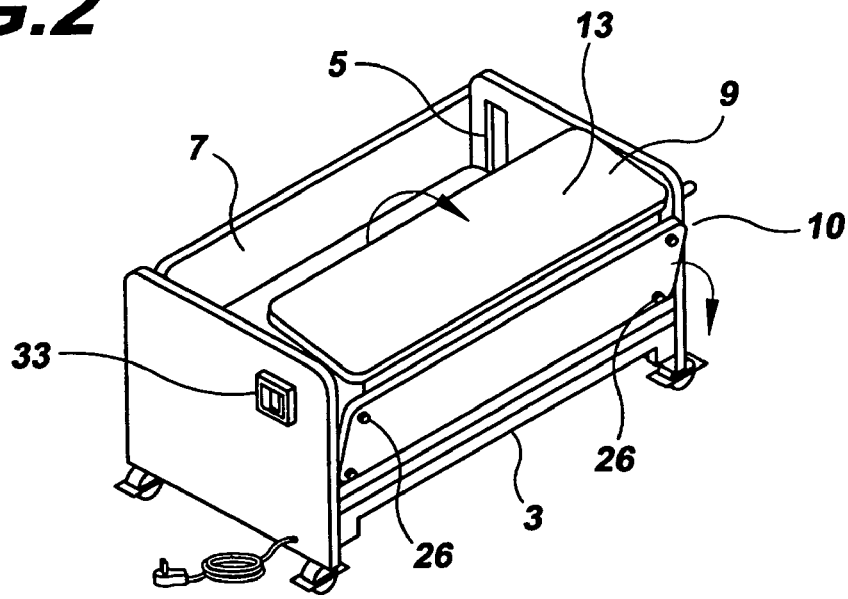
FIG. 2 is a perspective view of the convalescent bed with the deployable guard rail in the partially expanded position.
Figure 3:
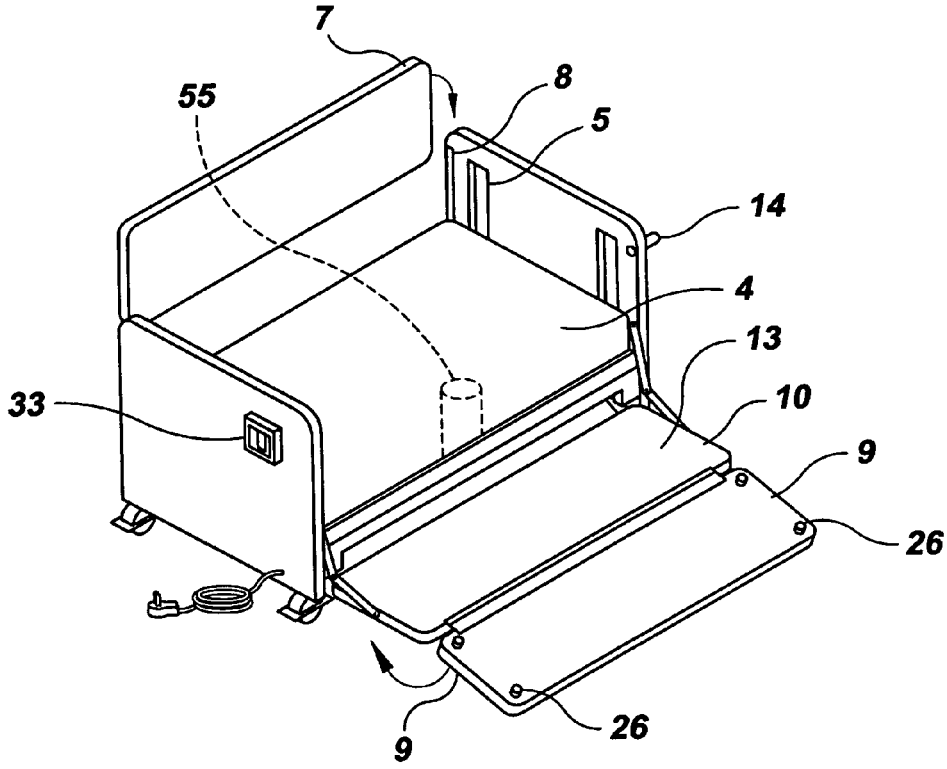
FIG. 3 is a perspective view of the convalescent bed according to the present invention with the expandable guard rail in a substantially deployed position.

Referring now to FIGS. 1 through 3, the present invention relates to a convalescent bed. The device comprises a substantially rectangular bed frame 1 including a pair of opposing end boards 2 with a mattress support structure 3 extending therebetween. A mattress 4 rests on the support structure. Each end board includes an inwardly facing side with a pair of vertically disposed guide tracks 5 positioned thereon. Each guide track receives a protrusion extending from an end of the support structure for guiding it upwardly or downwardly. An electrical or hydraulic lifting means 55 is positioned beneath the mattress support structure for automatically raising and lowering the mattress relative to the end boards. The lifting means is operated with a control panel 33 positioned on one of the end boards.

Positioned adjacent each of two sides of the mattress and extending between the spaced end boards is a guard rail 7, 20. A first guard rail 7 includes an elongated panel having a padded inner surface. The panel includes two opposing ends each of which are slidably received within a track 8 positioned on the end board allowing the panel to be easily removed. The opposing guard rail 20 includes a pair of hingedly joined panels 9,10 each having a padded inwardly facing surface 13. A first panel 10 includes a pair of opposing side edges that are hingedly coupled to the lower edge of respective end panels as depicted in FIG. 3. When the guard rail is erected to surround a bedridden patient, one panel is collapsed onto the other and the panels are placed in a vertical position as depicted in FIG. 1. Accordingly, the padded inner surface of a second panel 9 will be facing inwardly thereby providing a padded barrier about the mattress. The guard rail is secured in the collapsed, vertical position with one or more spring-biased pins 14.

The outer surfaces of both panels include foot pads 26 to elevate the panels a predetermined distance off the ground so as not to impinge feet or hands. Similarly, the mattress support structure includes foot pads on the lower surface thereof.

To properly restrain a patient within the bed, a user activates an appropriate switch on the lift means control panel thereby lowering the mattress to a height that is proximal ground level. The erected guard rails thereby prevent the patient from inadvertently falling out of the bed. If a medical professional needs to render care to the patient, the guard rail 20 may be deployed using the release pin. Accordingly, the first outer panel is pivoted to a substantially horizontal position while the second panel is folded underneath thereby forming a padded ramp on which the patient will land in the event he or she inadvertently rolls out of bed. Furthermore, the ramp provides a work surface for placing trays, medications or that otherwise assists a nurse in rendering appropriate care.

The above described device is not limited to the exact details of construction and enumeration of parts provided herein. For example, though one deployable ramp and one sliding ramp are depicted and described, both panels can be deployable. Any conventional lifting means can be used. Furthermore, the size, shape and materials of construction can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A convalescent bed comprising:

a frame including a mattress support structure, said frame including a pair of opposing end boards with said mattress support structure disposed therebetween, said mattress support structure including two opposing ends, each of which is slidably fastened to one of said end boards;

a mattress supported by said support structure;

means for automatically raising and lowering said support structure;

a pair of guard rails positioned adjacent each of two opposing sides of said mattress support structure for retaining a patient on said mattress, at least one of said guard rails including a pair of pivotally joined panels that are unfolded to form a substantially horizontal deployment ramp.

2. The convalescent bed according to claim 1 wherein said means for automatically raising and lowering said mattress support structure includes an automated lifting means secured to said mattress support structure.

3. The convalescent bed according to claim 1 wherein one of said guard rails includes an elongated panel having two opposing ends, each end slidably received within a designated track disposed on one of said end boards.

4. The convalescent bed according to claim 1 wherein each of said guard rails includes a padded inner surface.

* * * * *